US010590601B2

(12) United States Patent
Fu et al.

(10) Patent No.: US 10,590,601 B2
(45) Date of Patent: Mar. 17, 2020

(54) PRINTABLE MEDIUM

(75) Inventors: Xulong Fu, San Diego, CA (US); Xiaoqi Zhou, San Diego, CA (US); Ronald J. Selensky, Poway, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 708 days.

(21) Appl. No.: 14/405,771

(22) PCT Filed: Aug. 31, 2012

(86) PCT No.: PCT/US2012/053383

§ 371 (c)(1),
(2), (4) Date: Dec. 4, 2014

(87) PCT Pub. No.: WO2014/035414

PCT Pub. Date: Mar. 6, 2014

(65) Prior Publication Data

US 2015/0152592 A1 Jun. 4, 2015

(51) Int. Cl.
*D06P 5/30* (2006.01)
*B41M 5/50* (2006.01)
(Continued)

(52) U.S. Cl.
CPC ..... *D06P 5/30* (2013.01); *B41M 5/508* (2013.01); *D06B 21/00* (2013.01); *B41M 5/506* (2013.01); *B41M 5/52* (2013.01); *Y10T 428/2481* (2015.01)

(58) Field of Classification Search
CPC ..... D06P 5/30; D06P 1/65162; B41M 5/52; B41M 5/50–529; B32B 2307/40;
(Continued)

(56) References Cited

U.S. PATENT DOCUMENTS 3,003,912 A * 10/1961 Harford ..... D21H 5/20
162/157.5
4,457,960 A * 7/1984 Newsome ..... B32B 27/08
428/34.9

(Continued)

FOREIGN PATENT DOCUMENTS

CN 998162728 3/2005
CN 101122164 2/2008

(Continued)

OTHER PUBLICATIONS

"Nonwoven Fabric." Complete Textile Glossary. New York, NY: Celanese Acetate, 2001. N. pag. Print.*

(Continued)

*Primary Examiner* — Laura C Powers
*Assistant Examiner* — Larissa Rowe Emrich
(74) *Attorney, Agent, or Firm* — Dierker & Kavanaugh PC

(57) ABSTRACT

Examples of a printable medium are disclosed herein. In one example, the printable medium includes an opaque substrate that is substantially free of polyvinyl chloride (PVC). The substrate includes a fabric core having $I(x)/I_0$ equal to or less than 0.005, wherein I(x) is an intensity of light remaining at a distance, x, where x is the distance that light travels through the substrate, and wherein $I_0$ is an initial intensity of light at x=0. The substrate further includes a discrete barrier layer disposed on the fabric core. The barrier layer includes a copolymer of ethylene and vinyl acetate having a polyethylene-to-vinyl acetate ratio ranging from about 20:1 to about 9:1. The printable medium further includes a tie layer coated on the discrete barrier layer, and an image receiving layer coated on the tie layer.

25 Claims, 2 Drawing Sheets

(51) Int. Cl.
*D06B 21/00* (2006.01)
*B41M 5/52* (2006.01)

(58) Field of Classification Search
CPC ..... B32B 2307/402; B32B 2307/4023; D06N 7/0002; D06N 2201/0218–00281; D06N 2203/042; D06N 2203/045–047; D06N 2209/0815; D06N 2209/0823; D06N 2211/063; D06B 21/00; Y10T 428/2481
USPC ..... 428/32.1–32.38
See application file for complete search history.

(56) References Cited

U.S. PATENT DOCUMENTS 5,376,237 A * 12/1994 Ishiguro ..... D21H 11/08 162/134
5,422,189 A 6/1995 Warner et al.
5,856,001 A * 1/1999 Okumura ..... B41M 5/52 347/105
5,942,335 A * 8/1999 Chen ..... B41M 5/5245 347/105
5,985,424 A * 11/1999 DeMatte ..... B41M 5/506 428/212
6,316,120 B1 * 11/2001 Emslander ..... B41M 5/5254 347/105
6,350,507 B1 * 2/2002 Iwamoto ..... B41M 5/5218 428/32.33
6,579,602 B1 6/2003 Freedman
6,793,860 B2 9/2004 Xing et al.
7,785,764 B2 8/2010 Williams
7,807,240 B2 10/2010 Francis et al.
7,867,584 B2 1/2011 Bi et al.
2001/0041247 A1 11/2001 Scheffer et al.
2002/0110685 A1 8/2002 Ebihara et al.
2003/0027474 A1 * 2/2003 Hayes ..... B32B 27/12 442/149
2004/0061753 A1 * 4/2004 Chen ..... B41M 5/0023 347/100
2004/0126509 A1 * 7/2004 Schade ..... B41M 5/52 428/32.1
2006/0154003 A1 * 7/2006 Trouilhet ..... B32B 27/08 428/32.24
2006/0222789 A1 10/2006 Dontula et al.
2006/0222828 A1 * 10/2006 Sinto ..... D06N 3/042 428/195.1
2007/0202263 A1 * 8/2007 Kitamura ..... B41M 5/52 427/407.1
2007/0292638 A1 * 12/2007 Kim ..... B41M 5/502 428/32.2
2008/0090033 A1 * 4/2008 Fu ..... B41M 5/504 428/32.39
2009/0202753 A1 * 8/2009 Teramae ..... B32B 27/08 428/32.2
2010/0080940 A1 * 4/2010 Godey ..... B29C 43/222 428/32.18
2011/0003097 A1 * 1/2011 Chen ..... B41M 5/504 428/32.21
2011/0076427 A1 * 3/2011 Hyakuda ..... B41M 5/52 428/32.1
2011/0104408 A1 * 5/2011 Wang ..... B41M 5/508 428/32.3
2011/0212278 A1 * 9/2011 Watanabe ..... B05D 1/265 428/32.18
2012/0118479 A1 5/2012 Bamberg et al.

FOREIGN PATENT DOCUMENTS

EP 0750022 A2 * 12/1996 ..... C08G 81/021
EP 0912348 B1 5/2000
EP 1321300 A1 6/2003
EP 1571000 A2 9/2005
JP 2000168246 6/2000
JP 2004042655 2/2004
KR 10-1066720 9/2011
WO WO 2012/047203 4/2012
WO WO 2012102737 A1 * 8/2012 ..... C09J 133/08

OTHER PUBLICATIONS

"Web." Complete Textile Glossary. New York, NY: Celanese Acetate, 2001. N. pag. Print.*
Scott, Chris. "Poly(vinyl Alcohol)." Poly(vinyl Alcohol) Information and Properties. Polymerprocessing.com, Apr. 29, 2003. Web. May 24, 2017. <http://www.polymerprocessing.com/polymers/PVOH.html>.*
"Glass Transition Temperature." Plastics Glass Transition Temperature (Tg): Definition & Values. SpecialChem, n.d. Web. May 24, 2017. <http://omnexus.specialchem.com/polymer-properties/properties/glass-transition-temperature>.*
Group, Network Services. Emulsion Styrene-Butadiene Rubber (E-SBR) (n.d.): n. pag. IISRP. International Institute of Synthetic Rubber Producers, Jul. 16, 2004. Web. May 24, 2017. <http://iisrp.com/webpolymers/09e-sbrpolymersummaryjuly16.pdf>.*
"Fiber." Complete Textile Glossary. New York, NY: Celanese Acetate, 2001. N. pag. Print.*
"Taber Stiffness Tester ." Taber Industries. Taber Industries, 2011. Web. <https://www.taberindustries.com/stiffness-tester>. (Year: 2011).*
Choudhury, Namita Roy De, Prajna P. Dutta, Naba K.. (2010). Thermal Analysis of Rubbers and Rubbery Materials—4.3.3.3 Influence of Crosslinking. (pp. 165-167). Smithers Rapra Technology. Retrieved from https://app.knovel.com/hotlink/pdf/id:kt007F1BQ6/thermal-analysis-rubbers/influence-crosslinking (Year: 2010).*
European Patent Office, Extended European Search Report, European Patent Application No. 12883885.1, dated Oct. 19, 2015, 8 pages.

* cited by examiner

PRINTABLE MEDIUM

BACKGROUND

Commercial displays may be used to advertise information or other messages to consumers/potential consumers. In some instances, the commercial display includes a banner upon which an ink is to be printed to form an image. The image may, for example, represent the advertisement of the information or other messages for the consumers/potential consumers.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
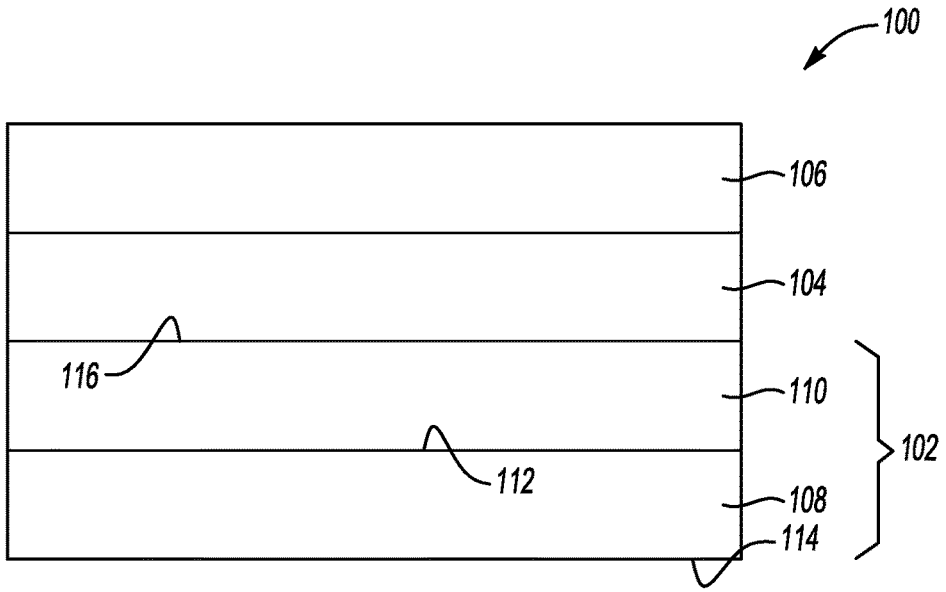
FIG. 1 schematically depicts an example of a printable medium.

The present disclosure relates generally to printable media.

The examples of the printable medium, as disclosed herein, may be used as a banner for a display, such as a commercial display including, e.g., billboards, signs, building wraps, and/or the like. The printable medium is specifically designed to receive thereon any digitally printable ink, such as, for example, organic solvent-based inkjet inks or aqueous-based inkjet inks. Some examples of inkjet inks that may be deposited, established, or otherwise printed on the examples of the printable medium include pigment-based inkjet inks, dye-based inkjet inks, pigmented latex-based inkjet inks, and UV curable inkjet inks.

The digital printable ink may be deposited, established, or printed on the printable medium using any suitable inkjet printing device. In an example, the ink may be deposited, established, or printed on the printable medium via thermal inkjet printing devices and piezoelectric inkjet printing devices.

Additionally, the examples of the printable medium are also designed to receive thereon a solid toner or a liquid toner. The solid toner or the liquid toner may include toner particles made, e.g., from a polymeric carrier and one or more pigments. The liquid toner may be a solvent-based (e.g., hydrocarbon) liquid toner. The solid toner or the liquid toner may be deposited, established, or otherwise printed on the examples of the printable medium using, respectively, a suitable dry or liquid press technology, such as a dry toner electrophotographic printing device or a liquid toner electrophotographic printing device.

The examples of the printable medium are recyclable, and include at least a substrate that is substantially free of polyvinyl chloride (PVC). The lack of PVC in at least the substrate of the printable medium is generally desirable, for example, to avoid a possibility of the production of any undesirable and/or toxic chemicals (hydrochloric acid and carcinogenic dioxins) that may generate from the PVC during decomposition of the printable medium, e.g., during recycling.

As used herein, the term "substantially", with reference to the lack of PVC in the substrate, means that there is a trace amount, if any at all, of PVC present in the substrate. In one example, a substrate that is substantially free of PVC is one that includes no PVC. In another example, a substrate that is substantially free of PVC is one that includes no more than about 0.01 wt % of PVC. In another example, the printable medium, as a whole, is substantially free of PVC (i.e., no PVC or a trace amount of PVC may be found in any of the layers (e.g., the substrate, the tie layer, and the image receiving layer) of the examples of the printable medium disclosed herein). In some instances, the trace amount of PVC that may be present in the substrate and/or the whole printable medium is so small that the presence of the PVC cannot be detected using any suitable PVC detection device or equipment. In such instances, the substrate and/or the whole printable medium is also said to be substantially free of PVC.

The substrate of the examples of the printable medium may be described herein at least in terms of its opacity. As used herein, the opacity of the substrate refers to the impenetrability of the substrate to visible light. As such, an opaque substrate is one that is neither transparent nor translucent. In an example, the opaque substrate will reflect, scatter, or absorb all of the electromagnetic waves in the spectrum range at which a human eye will respond, which is known as visible light; i.e., wavelengths ranging from about 390 nm to about 750 nm. In another example, the opaque substrate has zero light transmission within the visible light spectrum. In yet another example, the opacity of the substrate may be described by Equation (1):

$$I(x)=I_0e^{-\kappa_\nu\rho x} \quad \text{(Eqn 1)}$$

where x is the distance that light travels through the substrate (i.e., the thickness of the substrate measured in meters), I(x) is the intensity of light (measured in $W/m^2$) remaining at the distance x, $I_0$ is the initial intensity of light (measured in $W/m^2$) when x is zero (i.e., when the distance x is equal to 0), v is the light frequency (measured in Hz), ρ is the mass density of the substrate (measured in $kg/m^3$), and $\kappa_\nu$ is the opacity of the substrate. In an example, an opaque substrate is one where the opacity $\kappa_\nu$ is greater than a value that, when used in Equation 1, renders $I(x)/I_0$ as being no larger than 0.005.

Referring now to FIG. 1, an example of a printable medium 100 includes a substrate 102, a tie layer 104 coated on the substrate 102, and an image receiving layer 106 coated on the tie layer 104. The tie layer 104 is generally incorporated into the printable medium 100 for the purpose of adhering the image receiving layer 106 to the underlying substrate 102. In this way, it may be said that the image receiving layer 106 is coated on the substrate 102.

Figure 2:
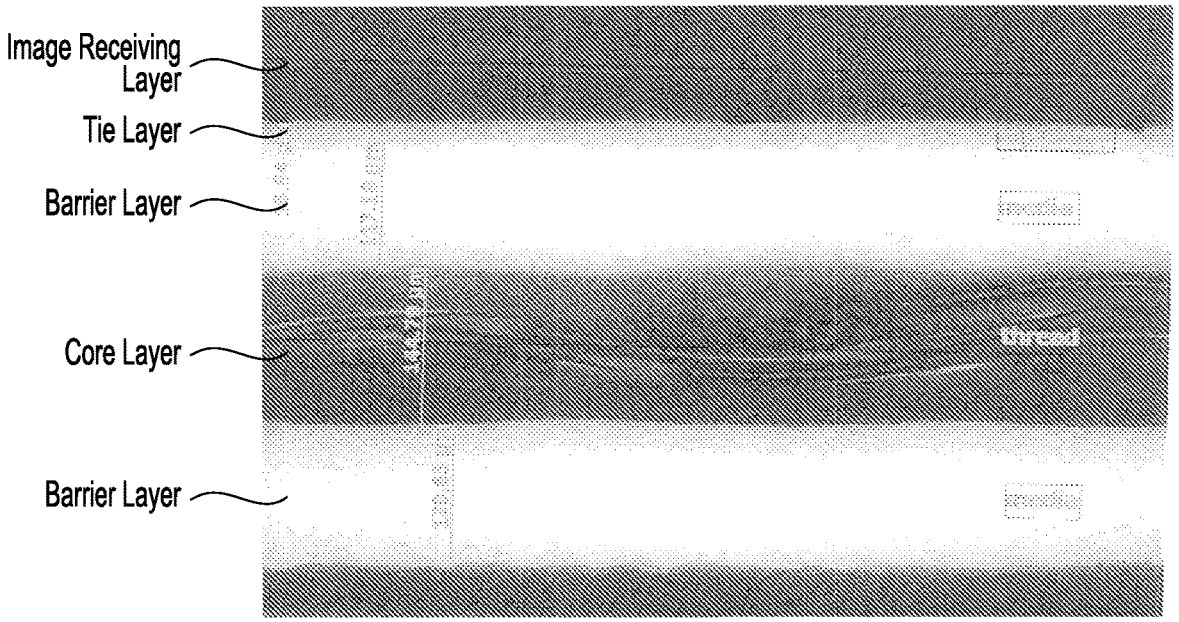
FIG. 2 is a scanning electron microscope (SEM) image of the example of the printable medium of FIG. 1.

The substrate 102 includes a fabric core formed as a layer 108 (which will be referred to hereinbelow as the core layer 108) and a barrier layer 110 disposed on a surface 112 of the core layer 108. In another example, which is shown in FIG. 2, the core layer 108 may be sandwiched between two barrier layers 110; i.e., one barrier layer 110 is disposed on the surface 112 of the core layer 108, and another barrier layer (not shown in FIG. 1, but shown in FIG. 2) is disposed on an opposed surface 114 of the core layer 108.

The core layer 108 is a fabric core as mentioned above. Examples of suitable fabrics include textiles, cloths, and/or other flexible materials made from natural and/or synthetic fibers. Some examples of fabric cores including natural fibers include those having fibers of wool, cotton, silk, linen, jute, flax, hemp, rayon, and/or thermoplastic aliphatic polymers derived from renewable, natural resources such as corn starch, tapioca, sugarcanes (e.g., polylactic acid, which is also known as polylactide (PLA)), and/or combinations thereof. Some examples of fabric cores including synthetic fibers include those having fibers of polyesters, polyamides, polyimides, polyacrylics, polypropylenes, polyethylenes, polyurethanes, polystyrenes, polyaramids (e.g., KEVLAR®), polytetrafluoroethylene (e.g., TEFLON®), fiberglass, polytrimethylene, polycarbonates, polyester terephthalate, polybutylene terephthalate, nylon, polyvinyl alcohol, polyvinyl acetate, and/or combinations thereof. In an example, the fabric core may be made up of mixtures, combinations, and/or blends of two or more natural fibers, of two or more synthetic fibers, or of at least one natural fiber and at least one synthetic fiber.

One or more additives may also be added to the fabric core 108, examples of which include antistatic agents, brightening agents, nucleating agents, antioxidants, UV stabilizers, fillers, lubricants, and/or the like.

It is to be understood that the fabric of the core layer 108 may have any desirable construction. In an example, the fabric is made up of woven fiber structures, non-woven fiber structures, knitted fiber structures, tufted fiber structures, and/or the like. Examples of woven fiber structures include woven textiles, such as, e.g., satin, poplin, and crepe weave textiles. Examples of knitted fiber structures include knitted textiles, such as, e.g., textiles having a circular knit, a warp knit, or a warp knit with a microdenier face. Furthermore, the fabric structure may have a flat configuration, or may resemble a pile of fabrics.

In an example, a woven fabric structure may be made by weaving together a plurality of natural and/or synthetic fiber structures at a desired weaving density, in any of a warp direction or a weft direction. Weaving may be accomplished to produce a fabric having any desired weave pattern. Further, the fibers of the fabric core may be woven together using any suitable fabric weaving process/machine, including those that utilize a tape loom or a broad loom.

Knitting may be accomplished in a similar manner to weaving, except that the knitting involves knitting together a plurality of natural and/or synthetic fibers to form stiches of a desired stich density in any of a warp direction or a weft direction. Furthermore, tufting involves weaving or knitting clumps of fibers to form the fabric structure.

Non-woven fiber structures include fiber structures that are bonded together by any of a chemical treatment process (e.g., solvent treatment and chemical bonding processes, such as a wetlaid process), a mechanical treatment process (e.g., embossing), or a thermal treatment process (e.g., heating and pressing processes). When bonded, the fiber structures are attached to one another, however the fibers do not necessarily form a weave.

It is to be understood that the fabric core 108 is responsible, at least in part, for the opacity of the substrate 102. In an example, the fabric(s) may be chosen from one/those that exhibit an optical property that will render the substrate 102 as being opaque. In another example, the fabric(s) may be chosen from any desirable fabric(s), and the fabric(s) may be color treated to impart the desired opacity to the substrate 102. For example, color treating may reduce the light transparency and/or translucency. Color treating may be accomplished by adding a colorant to the fabric(s) to change the color of the fabric(s) to a desirable color. For instance, carbon black pigment may be added to the natural and/or synthetic fiber structure to change the color of the natural and/or synthetic fiber structure to black. The carbon black in this example will act as a light blocker, rendering the core layer 108 (and thus the substrate 102) opaque. In another example, titanium dioxide ($TiO_2$) pigment may be added to the natural and/or synthetic fiber structure of the core layer 108 to increase the opacity of the fiber structure. In this example, the $TiO_2$ pigment will impart a stronger light reflectivity property to the fiber structure, which will reduce the transparency of fiber structure of the core layer 108. In yet another example, the fabric(s) may be color treated with a dye or a tint.

In an example, the core layer 108 is chosen from a fabric(s) and/or the fabric(s) is/are color treated so that the core layer 108 exhibits a color defined by the color space coordinate L* of the color space method, where L* defines the lightness of the fabric. Generally, a high L* indicates a brighter-colored material, while a low L* indicates a deeper-colored material. The fabric may, in an example, have a color space coordinate L* that is less than 30, and at this color space value, the fabric exhibits a relatively deep color that can readily absorb light within the visible spectrum range. In another example, the fabric may have an L* value of about 0 and the fabric core will exhibit a black color.

It is to be understood that the color of the core layer 108 may be a color other than a black color, such as a grey color or a white color. In any of these examples, the opacity of the core layer 108 may be defined by $I(x)/I_0$ as being no larger than 0.005. It is to be understood that for some colors, the L* may be greater than 30. For example, the L* of a white color having $I(x)/I_0$ less than or equal to 0.005 is greater than 70. In these examples, the substrate 102 will still be opaque.

In instances where the fabric of the core layer 108 is such that, in and of itself, it does not render the substrate 102 as being opaque, the thickness of the core layer 108 may be adjusted to achieve the desired opacity. For some materials, the opacity increases as the thickness increases. In an example, when the fabric of the core layer 108 renders the substrate 102 as being less than opaque (e.g., the ratio of $I(x)/I_0$ is about 0.01), then the thickness of the core layer 108 may be increased by about 100 microns to about 115 microns to render the substrate 102 as being opaque. In some examples disclosed herein, both the color of the core layer 108 and the thickness of the core layer 108 may be adjusted to achieve the desired $I(x)/I_0$ of no greater than 0.005.

In an example, the thickness of the core layer 108 ranges from about 50 microns to about 500 microns, and in another example, the thickness of the core layer 108 ranges from about 100 microns to about 250 microns.

The fabric for the core layer 108 may also be chosen to impart a desirable mechanical property (e.g., durability) to the core layer 108. For instance, the fabric of the core layer 108 may have a machine direction tensile strength, measured using an Intron device available from Testing Machines, Inc. (Newcastle, Del.), that is greater than 500 N/mm.

In some instances, the fabric(s) may contain a small amount of PVC. For example, if the fabric(s) used are made up of recycled fibers, they may be contaminated with small amounts of PVC. In an example, the amount of PVC present in the fabric is less than about 0.01 wt % of the total wt % of the fabric making up the core layer 108. It is further to be understood that when the fabric is made, the process may be accomplished without adding any PVC to the fabric. In this case, the core layer 108 is free of PVC.

Referring still to FIG. 1, although the core layer 108 may be the main contributor to substrate 102 stiffness, it is to be understood that the barrier layer 110 of the substrate 102 may be designed to provide additional stiffness and/or some physical support to the softer fabric core layer 108. In an example, the stiffness of the fabric core layer 108 ranges from about 5 gf·cm to about 100 gf·cm (i.e., from about $0.049*10^{-2}$ N·m to about $0.981*10^{-2}$ N·m) measured by a Taber Stiffness Tester available from Taber Industries (North Tonawanda, N.Y.). The barrier layer(s) 110 may also provide a relatively smooth surface upon which the tie layer 104 will be coated, and in some instances, may also contribute to the aesthetic appearance of the substrate 102.

In an example, the barrier layer 110 is a discrete layer that is formed by extruding a barrier composition onto the surface 112 of the core layer 108. In instances where the printable medium 100 includes another barrier layer (again, not shown in FIG. 1 but see FIG. 2), the other barrier layer is formed by extruding the barrier composition onto the surface 114 of the core layer 108. It is to be understood that the term "discrete", when used with reference to the barrier layer 110, means that the barrier layer 110 is an individually separate or distinct layer from the core layer 108. As a discrete layer, for instance, no portion of the barrier layer 110 is or becomes part of core layer 108. In other words, no diffusion of the barrier composition into the core layer 108 takes place upon forming the barrier layer 110 on the core layer 108. Likewise, no portion of the core layer 108 becomes part of the barrier layer 110 when the barrier layer 110 is formed thereon. It is to be understood, however, that some interlocking between the barrier layer 110 and the core layer 108 at the interface occurs. However, such interlocking does not involve any diffusion of the barrier layer 110 into the core layer 108. This is shown in a scanning electron microscope (SEM) image of an example of the printable medium in FIG. 2, where the fabric core is sandwiched between two barrier layers. Each of the barrier layers is formed as a separate, discrete layer from the core layer 108.

The separate core layer 108 and barrier layer(s) 110 have distinct properties, such as light transmission, light reflectance, and/or light absorbance. These properties may be the same or different.

In an example, the barrier layer 110 includes a copolymer of ethylene and vinyl acetate, such as, e.g., polyethylene-co-vinyl acetate (PEVA). PEVA is generally known for its flexibility and toughness, even at low temperatures (e.g., less than or equal to −40° C.), and further exhibits desirable adhesion characteristics and stress cracking resistance. PEVA for the barrier layer 110 has a polyethylene-to-vinyl acetate ratio ranging, for example, from about 20:1 to about 9:1. At this ratio (i.e., with this amount of vinyl acetate), the PEVA is relatively soft due, at least in part, to a decreased crystallinity, however the PEVA still maintains an effective crystalline structure for mechanical stress. It is believed that PEVA containing polyethylene-to-vinyl acetate ratios that are outside of the range disclosed above is more difficult to process and has less desirable physical properties (e.g., stiffness) than PEVA having the polyethylene-to-vinyl acetate ratios disclosed above.

In some examples, the barrier layer(s) 110 is made of PEVA and is free of homopolymers, such as polyethylene and polypropylene homopolymers.

In other examples, the barrier layer 110 may include the copolymer of ethylene and vinyl acetate (e.g., PEVA) in combination with a polyolefin resin such as high density polyethylene (which has a density ranging from about 0.93 g/mL to about 0.97 g/mL, and may be abbreviated as HDPE), low density polyethylene (which has a density ranging from about 0.91 g/mL to about 0.94 g/mL, and may be abbreviated as LDPE), or polypropylene; copolymers of ethylene with other alkenes such as linear low density polyethylene; polylactic acid (PLA); and polyethylene terephthalate (PET). In one particular example, the polymer of the barrier layer 110 is a blend of PEVA and low density polyethylene (LDPE). Blending of PEVA into the polymer matrix of the LDPE produces a compatible polymer blend having improved flexibility, toughness, and resistance to stress cracking, and exhibits increased adhesiveness with other layers (e.g., the tie layer 104). In an example, the ratio of LDPE-to-PEVA ranges from about 1:99 to about 50:50.

It is to be understood that the barrier layer(s) 110 does not include a copolymer or polymer that includes a chlorine element.

In an example, the barrier layer 110 further includes an inorganic particulate material and perhaps one or more additives (e.g., colorants, optical brighteners, release agents, etc.). The inorganic particulate material may be chosen from any suitable inorganic filler material. Some examples of inorganic filler materials include carbon black, calcium carbonate, talc, barium sulfate, clay, silica, and $TiO_2$. In an example, less than 40 wt % of the inorganic filler material is present in the barrier layer 110. In another example, the inorganic filler material is present in the barrier layer 110 in an amount ranging from about 5 wt % to about 15 wt % of a total wt % of the barrier layer 110.

It is to be understood that the presence of any of the inorganic filler materials in the barrier layer 110 may affect (e.g., improve) the opacity of the substrate 102. For example, the inclusion of carbon black as the inorganic filler material in the barrier layer 110 may improve the overall opaqueness of the substrate 102. If the inorganic filler material in the barrier layer 110 improves opaqueness, the colorant in the core layer 108 and/or the thickness of the substrate 102 may be altered so long as the $I(x)/I_0$ is equal to or less than 0.005. In general, any of these three parameters (i.e., amount of colorant in the core layer 108, total substrate 102 thickness, and amount of filler material in the barrier layer 110) may be adjusted in order to achieve the desired opacity.

The thickness of the barrier layer 110 ranges, for example, from about 10 microns to about 50 microns, and in another example, the thickness of the barrier layer 110 ranges from about 15 microns to about 30 microns.

In an example, the substrate 102 of the printable medium 100 has a basis weight ranging from about 50 grams per square meter (gsm) to about 500 gsm, and in another example, a basis weight ranging from about 150 gsm to about 300 gsm. Further, the substrate 102 has a thickness ranging, for example, from about 50 microns to about 500 microns, and in another example, the substrate 102 has a thickness ranging from about 100 microns to about 300 microns. It is to be understood, however, that in instances where the thickness of the core layer 108 is adjusted to achieve a desired opacity (as previously mentioned), then the range of the total thickness of the substrate 102 stated above will be adjusted accordingly. For one instance, if the thickness of the core layer 108 is increased by about 100 microns, then the total thickness of the substrate 102 will range from about 150 microns to about 600 microns. For another instance, if the thickness of the core layer 108 is increased by about 115 microns, then the total thickness of the substrate 102 will range from about 165 microns to about 615 microns.

As previously mentioned, the examples of the printable medium 100 further include a tie layer 104 that is coated on the barrier layer 110 of the substrate 102. In instances where the core layer 108 is sandwiched between two barrier layers 110, then the tie layer 104 is disposed on one of the barrier layers 110 (as shown in FIG. 2). Further, in instances where the core layer 108 is sandwiched between two barrier layers 110, another tie layer may be coated on the other barrier layer.

The tie layer 104 is basically an adhesive layer that is formulated specifically to adhere the image receiving layer 106 to the underlying substrate 102. This tie layer 104 may be required because the polymer(s) making up the substrate 102 (i.e., the core layer 108 and the barrier layer 110) generally has/have a relatively low surface energy that renders the substrate 102 as having a poor adhesive property.

In an example, the tie layer 104 includes a polymeric tie component and a crosslinking agent. The polymeric tie component is chosen from a material that will suitably adhere the image receiving layer 106 to the substrate 102 when the image receiving layer 106 is coated thereon. The polymeric tie component is also chosen from a material that, when incorporated into a tie solution that is applied to the substrate 102 to form the tie layer 104, allows the tie solution to be wet coated onto the substrate 102. In an example, the polymeric materials capable of being wet coated include polymers having a glass transition temperature ($T_g$) ranging from about −80° C. to about 0° C. In another example, the $T_g$ of the polymer chosen for the polymeric tie component ranges from about −50° C. to about −10° C.

It is believed that tie solutions containing a polymeric tie component having a $T_g$ that is higher than 0° C. cannot be suitably wet coated, and as such, these polymers cannot be used in any of the examples of the tie layer 104 of the printable medium 100 disclosed herein. It is further believed that a polymeric tie component having a $T_g$ falling within the disclosed ranges above has a suitable adhesive property to non-removably adhere the image receiving layer 106 to the substrate 102. Examples of polymer materials for the polymeric tie component include polar materials; i.e., those having any of a hydroxyl group, a ketone group, an amine group, or another suitable functional group on the backbone of a carbon chain. The polar material chosen for the polymeric tie component is also crosslinkable. Some examples of polymeric tie components present in the tie layer 104 include polyvinyl alcohol, styrene butadiene resin latex, acrylic latex, polyacrylates, polyacrylate copolymers, and/or combinations thereof. Some specific examples of polymers that may be used as the tie component include poly(methyl acrylate-butadiene), poly(ethyl acrylate-butadiene), poly (propyl acrylate-butadiene), poly(butyl acrylate-butadiene), poly(acrylate-isoprene), poly(ethyl acrylate-isoprene), poly (propyl acrylate-isoprene), poly(butyl acrylate-isoprene), poly(styrene-butadiene), poly(methylstyrene-butadiene), poly(styrene-isoprene), poly(methylstyrene-isoprene), poly (styrene-propyl acrylate), poly(styrene-butyl acrylate), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly (styrene-butyl acrylate-methacrylic acid), poly(styrene-butyl acrylate-acrylononitrile), poly(styrene-butyl acrylate-acrylononitrile-acrylic acid), and combinations thereof. In one particular example, the polymeric tie component is polyvinyl alcohol.

In an example, the tie component is present in the tie layer 104 in an amount ranging, for example, from about 70 wt % to about 95 wt % of the total wt % of the tie layer 104.

The crosslinking agent of the tie layer 104 may generally be used to increase the hardness and adhesion strength of the tie layer 104. Examples of the crosslinking agent include boric acid and glyoxal. In an example, the crosslinking agent is present in the tie layer 104 in an amount ranging from about 5 wt % to about 30 wt % of the total wt % of the tie layer 104.

As mentioned above, the tie layer 104 is formed of a tie solution that is capable of being wet coated. As such, the tie solution is a liquid coating solution. It is believed that none of the tie components mentioned hereinabove, when incorporated into the tie solution to be coated on the substrate 102, will enable the tie solution to form a hot melt. Accordingly, the tie solution including any of the polymer materials for the polymeric tie component that are identified above cannot be deposited onto the substrate 102 using an extrusion process. Rather, in an example, the tie layer 104 is coated on the barrier layer 110 by coating the tie solution onto the barrier layer 110 using a wet coating method. Examples of wet coating methods include rod coating, roll coating, slot die coating, and/or blade coating.

After coating, the tie solution is dried to form a thin film on the barrier layer 110. Drying may be accomplished, for example, using a hot air dryer (e.g., 50° C. to 180° C.). In an example, the thickness of the thin film (i.e., the tie layer 104) ranges from about 0.1 microns to about 2 microns. In another example, the thickness of the thin film tie layer 104 ranges from about 0.2 microns to less than 0.5 microns. It is to be understood that these thickness ranges may be achieved by coating the tie solution onto the barrier layer 110.

Further, the coat weight of the tie layer 104 ranges, for example, from about 0.1 gsm to about 2 gsm. In another example, the coat weight of the tie layer 104 ranges from about 1 gsm to about 2 gsm.

In an example, the tie solution that is coated on the barrier layer 110 to form the tie layer 104 is made up of the tie component, the crosslinking agent, and a solvent. When the tie solution is coated onto the barrier layer 110, the solvent will substantially evaporate upon forming the thin film/tie layer 104. The tie layer 104 that is formed will then include the tie component, the crosslinking agent, and a small amount (e.g., from about 3 wt % to about 6 wt % (e.g., about 5 wt %) of the total wt % of the tie layer 104) of the solvent. The solvent may be chosen from any solvent so long as a difference in solubility between the tie component and the solvent is, for example, less than about 1.2 $(cal \cdot cm^{-3})^{1/2}$. In another example, the solvent is selected so the difference in solubility between the tie component and the solvent ranges, for example, from about 0.5 $(cal \cdot cm^{-3})^{1/2}$ to about 0.8 $(cal \cdot cm^{-3})^{1/2}$. The tie component solubility may be estimated, for example, using inverse gas chromatography. Examples of solvents that may be used for the tie solution include water, water and alcohol mixtures, or organic solvents, such as carbon tetrachloride, chlorobenzene, chloroform, cyclohexane, 1,2-dichoroethane, diethyl ether, diethylene glycol, ethylene glycol, 1,2-dimethoxyethane, dimethylether, dimethylformamide, dimethyl sulfoxide, dioxane, ethyl acetate, glycerin, pyridine, tetrahydrofuran, toluene, and m-xylene.

The image receiving layer 106 is generally formulated to receive thereon an ink (such as a pigment-based inkjet ink, a pigmented latex-based inkjet ink, a UV curable inkjet ink, and a dye-based inkjet ink) or a toner. The image receiving layer 106 is deposited on the substrate 102, and is strongly adhered to the substrate 102 by virtue of the tie layer 104. In an example, the image receiving layer 106 is formed by coating an image receiving composition onto the substrate 102; i.e., onto the tie layer 104 which is already coated on the substrate 102. The image receiving composition may be coated on the tie layer 104 using any of the wet coating methods previously mentioned for the coating of the tie layer 104 onto the barrier layer 110. Once coated, the image receiving composition dries to form a layer (i.e., the image receiving layer 106). In an example, the thickness of the image receiving layer 106 ranges from about 5 microns to about 30 microns. In another example, the thickness of the image receiving layer 106 ranges from about 10 microns to about 20 microns.

The image receiving composition generally includes a pigment, a binder, a colorant fixing agent, perhaps one or more additives, and water. In one example, the image receiving layer 106 is particularly suitable for receiving dye-based inks, and in this example, the image receiving layer 106 is specifically formulated to receive a dye-based inkjet ink thereon. Although this example of the image receiving layer 106 is formulated to receive dye-based inks, it is to be understood that this example of the image receiving layer 106 is also capable of receiving other inks such as pigment-based inkjet inks, pigmented latex-based inkjets, UV curable inks, and toners. This example of the image receiving layer 106 will now be described.

The pigment for the instant example of the image receiving layer 106 may, in an example, be chosen from silica gel (e.g., SILOJET™ 703C available from Grace Co., Japan), modified (e.g., surface modified, chemically modified, etc.) calcium carbonate (e.g., OMYAJET™ B6606, C3301, and 5010, all of which are available from Omya, Inc., Oftringen, Switzerland), precipitated calcium carbonate (e.g., JET-COAT® 30 available from Specialty Minerals, Inc., Bethlehem, Pa.), and combinations thereof. The modified calcium carbonate is modified, e.g., to improve the performance of the ink (e.g., the dye-based ink) to be received on the image receiving layer 106. The pigment(s) is/are present in the image receiving layer 106 in an amount ranging, for example, from about 65 wt % to about 85 wt % of the total wt % of the image receiving layer 106.

The binder for the instant example of the image receiving layer 106 may be chosen from a hydrophilic polymer or a hydrophobic polymer. One particular example of the binder is polyvinyl alcohol, such as KURARAY POVAL® 235, MOWIOL® 40-88, and MOWIOL® 20-98 (Kuraray America, Inc., Houston, Tex.). The binder is present in the image receiving layer 106 in an amount ranging, for example, from about 15 wt % to about 30 wt % of the total wt % of the total wt % of the image receiving layer 106.

Furthermore, the colorant fixing agent is chosen from calcium chloride and manganese (II) chloride, and the colorant fixing agent is present in an amount ranging, for example, from about 3 wt % to about 10 wt % of total wt % of the image receiving layer 106.

Examples of additives that may be incorporated into the instant example of the image receiving layer 106 include a crosslinking agent, a surfactant, a defoamer, a fixing agent, and/or a pH adjuster. In an example, the image receiving layer 106 includes from about 1 wt % to about 3 wt % of boric acid as a crosslinking agent, from about 0.5 wt % to about 2 wt % of glycerol, and about 1 wt % to about 5 wt % of a dye fixing agent (such as, e.g., LOCRON® P available from Clariant International Ltd. (Switzerland)). The image receiving layer 106 may also include a defoamer in an amount ranging from about 0.05 wt % to about 0.2 wt % of the total wt % of the image receiving layer 106. Examples of the defoamer include FOAMASTER® 1410, 1420, 1430, all of which are available from BASF Corp., Florham Park, N.J.

In another example, additional cationic additives may be added to the image receiving layer 106 based on the water-fastness required by the ink to be printed on the medium 100. A couple of examples of additional cationic additives that may be incorporated into the image receiving layer 106 include polydiallyldimethylammonium chloride (i.e., poly-DADMAC) and polyhexamethylene biguanide (PHMB). In an example, the amount of the cationic additives that may be incorporated into the image receiving layer 106 ranges from about 5 wt % to about 20 wt % of the total wt % of the image receiving layer 106.

To achieve suitable image quality, the surface pH of the printable medium 100 should range, for example, from about 4 to about 6.8. In another example, the surface pH ranges from about 4.5 to about 5.5. The desirable pH level of the printable medium 100 may be achieved by incorporating a pH adjuster into the image receiving layer 106 in an amount necessary to adjust the pH to fall within the desirable pH ranges mentioned above. Examples of the pH adjuster include diluted HCl which may be added to decrease the pH, and NaOH which may be added to increase the pH.

Another example of the image receiving layer 106 will now be disclosed herein. In this example, the image receiving layer 106 is specifically formulated to receive thereon pigment-based inks, such as pigment-based inkjet inks or pigmented latex-based inkjet inks, or toners. It is to be understood that this example of the image receiving layer 106 may be undesirable for a dye-based inkjet ink, in part because the image quality of the dye-based inkjet ink may be poor. This example image receiving layer 106 has a characteristic of being water resistant, and is a porous film including at least two pigments having different pigment structure morphologies. The different pigment structure morphologies contribute to a pore size distribution throughout the porous film.

The first pigment structure morphology is formed by crystalline pigment particles that, upon solidification of the image receiving composition to form the image receiving layer 106, form a loose packing structure with air voids (having a void volume ranging from about 1.4 mL/g to about 30 mL/g). The crystalline pigment particles themselves may be non-porous, but are able to create a porous structure within the image receiving layer 106 upon solidification. In other examples, the crystalline pigment particles themselves are micro-porous. In an example, the crystalline pigment particles forming this pigment structure morphology in the image receiving layer 106 have a discrete acicular morphology, and have an aspect ratio (defined by the ratio of the average length and average width of the crystalline pigment particle) ranging from about 50 to about 300. In yet another example, the aspect ratio of the crystalline pigment ranges from about 70 to about 180. In an example, the surface area of the crystalline pigment particles ranges from about 5 $g/m^2$ to about 25 $g/m^2$. As a specific example, the crystalline pigment forming the first pigment structure morphology is aragonite, which has a discrete or clustered needle-like orthorhombic crystal structure.

Some specific examples of the crystalline pigment particles that may be used include OPACARB® A40 (Specialty Minerals, Inc. (New York, N.Y.), kaolin clay, pigments of the MIRAGLOSS® family and pigments of the ANSILEX® family (BASF Corp., Florham Park, N.J.).

The second pigment structure morphology of the image receiving layer 106 is formed by an amorphous aggregated pigment that is structurally porous. As used herein, the term "structurally porous" means that the amorphous aggregated pigments themselves are porous. As such, the crystalline pigment particles described above may or may not be porous, and the amorphous aggregated pigments are porous.

In an example, the porous, amorphous aggregated pigment particles individually have a surface area ranging from about 50 $m^2/g$ to about 300 $m^2/g$, as measured using the BET method. The pore volume of the porous, amorphous aggregated particles ranges from about 1.4 mL/g to about 30 mL/g, as measured by a Mercury porsometer.

It is to be understood that the term "amorphous", when used to describe the pigment forming the second pigment structure morphology of the image receiving layer 106, means that the pigment has a higher dissolution rate compared to any other crystal form of the pigment (as characterized by x-ray diffraction or transmission electron microscopy). The amorphous pigment may still have some short-range structure order at the atomic length scale or larger. The amorphous pigment can also contain a fraction of crystals that coexist with the amorphous structure that can relax and decrease the structural order of the surface of the pigment particles as well as any interfacial effects. Examples of amorphous pigments include calcium carbonate crystal cores having an outerlayer of an amorphous material, such as amorphous silica, grafted thereon. Other examples of the amorphous pigments include precipitated silica. The precipitated silica has a moderate surface area (i.e., a surface area ranging from about 150 $g/m^2$ to about 300 $g/m^2$). Examples of the precipitated silica include GASIL® 23D and GASIL® 23F, both of which are available from PQ Corp., Malvern, Pa. Other examples of the amorphous aggregated pigments include OMYAJET® B6606, C3301, and 5010 (Omya, Inc., Cincinnati, Ohio).

In an example, the crystalline pigment particles and the porous, amorphous aggregated pigment are present in the image receiving layer 106 in a ratio ranging from about 0.7 to about 0.1. In another example, the porous, amorphous aggregated pigment is present in an amount ranging from about 60 parts to about 90 parts per 100 parts of total pigment, and the crystalline pigment is present in an amount ranging from about 10 parts to about 40 parts per 100 parts of total pigment.

The binder for the instant example of the image receiving layer 106 (i.e., the layer 106 that is formulated to receive pigment-based inks thereon) is chosen from one or more hydrophobic polymers to improve the water resistance of the image receiving layer 106. Examples of suitable hydrophobic binders for the instant example of the image receiving layer 106 include self-crosslinking acrylic polymers (e.g., JONCRYL® Flex 5000 (BASF Corp.)) and n-butyl acrylate-acrylonitrile-styrene copolymer (e.g., ACRONAL® S-866 (BASF Corp)).

Any of the colorant fixing agents and the additives described above may also be used in the example of the image receiving layer 106 that is formulated to receive pigment-based inks thereon.

Furthermore, it is to be understood that the pH of the image receiving layer 106 formulated to receive pigment-based inks thereon may range from about 5 to about 8.

Figure 3:
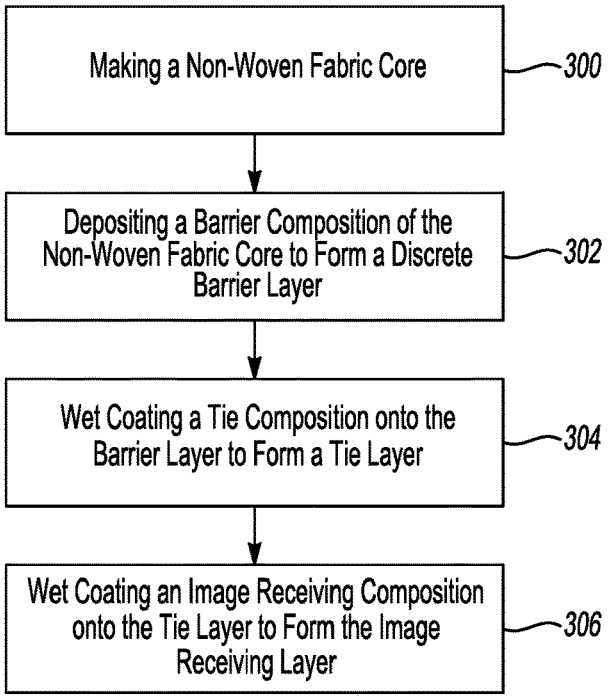
FIG. 3 is a flow diagram depicting an example of a method for making an example of the printable medium.

One example of a method of making the printable medium 100 when the core layer 108 includes a non-woven fabric is described hereinbelow in conjunction with FIG. 3. The method involves making the non-woven fabric at step 300. In an example, the non-woven fabric is made up of a plurality of polymer fibers and/or filaments. The non-woven fabric may then be made using any suitable textile process, or another suitable process, such as a spunbonding process. An example of a textile process is a dry-laid process which encompasses carding or garneting and air-laid processing. Textile processes produce polymer fibers or filaments of a desired size (e.g., diameter) and length. The spunbond process involves bonding the fibers using thermal, chemical, and/or mechanical means.

At step 302, a barrier composition is prepared and is then deposited on the surface 112 of the core layer 108 to form the discrete barrier layer 110. The barrier composition is prepared by combining the components of the barrier composition, and then feeding the barrier composition into an extruder. The composition may be extruded onto the surface 112 to form a layer thereon. The extrusion process may be carried out at a temperature that melts the resin of the barrier composition, and includes compressing the melted resin against the surface 112 of the core layer 108. The temperature used during extrusion will depend, at least in part, on the resin used in the barrier composition. In some examples, the temperature may range from about 200° C. to about 350° C. The layer formed on the surface 112 of the core layer 108 is thereafter allowed to cool, thereby forming the barrier layer 110. Cooling may be accomplished, for example, by chilling the layer formed on the core layer 108 using a chill roller with cold water (e.g., water at a temperature ranging from about 15° C. to about 25° C.).

In an example, to further improve the adhesive properties of the barrier layer 110 upon which the tie layer 104 will be applied, the barrier layer 110 may be subjected to a corona discharge treatment process prior to the deposition of the tie layer 104. During the corona discharge treatment process, high speed electrons accelerated during the corona burst reach an energy level of about 10 eV. Upon contacting the surface of the barrier layer 110, these electrons will break bonds on the surface of the barrier layer 110, which results in the formation of highly reactive free radicals on the surface. Then, the surface of the barrier layer 110 oxidizes to form polar groups thereon (e.g., hydroxyl, carbonyl, and amide groups), and these polar groups will improve bonding of the barrier layer 110 and the tie layer 104.

The tie composition is prepared by mixing together the polymeric tie component, the crosslinking agent, and the solvent. At step 304, the tie composition (which is a solution) is then wet coated onto the surface 116 of the barrier layer 110 to form the thin film mentioned above. After the tie composition has been coated on the barrier layer 110, the tie composition is allowed to dry, during which most of the solvent(s) in the solution evaporates. The thin tie layer 104 is formed.

The image receiving composition is prepared by mixing together the components making up the image receiving layer 106. Then at step 306, the image receiving composition is wet coated on the tie layer 104 to form the image receiving layer 106. Coating is accomplished, for example, using any of the wet coating methods that may be used to coat the tie layer 104 on the barrier layer 110.

Figure 4:
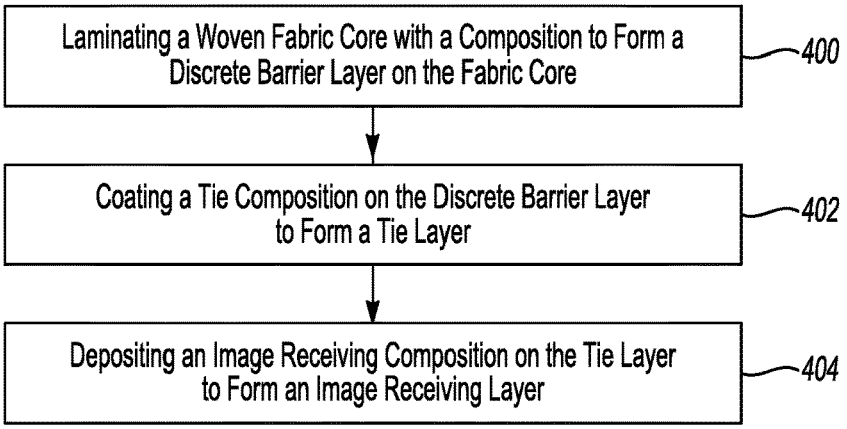
FIG. 4 is a flow diagram depicting another example of a method for making an example of the printable medium.

An example of a method for making the printable medium 100 when the core layer 108 has a woven fabric structure will now be described herein with reference to FIG. 4. In this example, at step 400, the method involves laminating the surface 112 of the fabric core layer 108 with the barrier composition to form the discrete barrier layer 110 thereon. In an example, laminating involves extruding the barrier composition onto the core layer 108 to form the discrete barrier layer 110 thereon.

In another example, the barrier layer 110 is already formed as a film, and in this example, the barrier layer 110 may be applied to the core layer 108 using an adhesive. A suitable adhesive includes a thermal adhesive, such as casein, starch, or a latex. In an example, the thermal adhesive may be coated onto one side of the barrier layer 110, and then the adhesive-coated barrier layer 110 may be wet laminated to the core layer 108. In another example, the thermal adhesive may be coated onto one side of the core layer 108, and then the barrier film 110 and the adhesive-coated core layer 108 may be wet laminated together. In still another example, both the barrier layer 110 and the core layer 108 may be coated with the adhesive and then wet laminated together.

Any of the adhesive coatings may be applied before combining the materials at a lamination nip. For example, a core layer web and a barrier layer web (with a surface of at least one of the webs including the wet adhesive) may be combined at the lamination nip and pressed together using a driven, chrome-plated steel roll and rubber coated pressure roll. Examples of wet lamination equipment that may be used include Talon 64 (152.4 cm wide web) from GBC, Lincolnshire, Ill.; 62 Pro laminating machine (152.4 cm wide web) from Seal, Elkridge, Md.; a lab unit lamination machine (60.96 cm wide web) for example, MATRIX DUD™; and those lamination machines from Polytype Converting Ltd., Freiburg, Switzerland. Other coating and laminating machines may be obtained from Faustel, Germantown, Wis. and Black Clawson Ltd, Newport, South Wales, UK, for example. Some laminating machines enable the core layer 108 to be coated on each side with the adhesive and then to be wet laminated with respective barrier layers 110 on each side.

Then, at step 402 the tie composition is coated on the barrier layer(s) 110 via a wet coating process to form the tie layer 104, and at step 404, an image receiving composition is wet coated on the tie layer 104 to form the image receiving layer 106.

Figure 5:
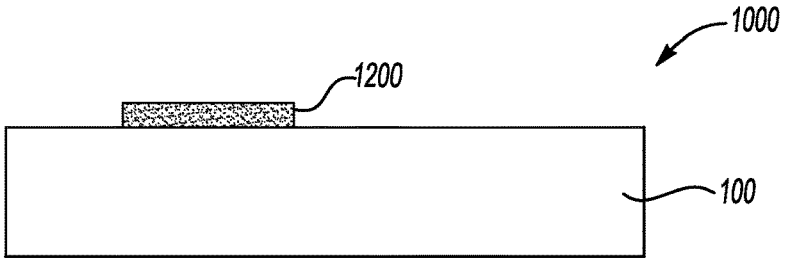
FIG. 5 schematically depicts an example of a printed article including an example of the printable medium and an ink deposited on a surface of the printable medium.

Also disclosed herein is a printed article 1000 as shown in FIG. 5. The printed article 1000 includes the printable medium 100 upon which an ink 1200 is deposited. As previously mentioned, for some examples of the printable medium 100, the ink may be chosen from a pigment-based inkjet ink, a pigmented latex-based ink, a UV curable inkjet ink, a dye-based inkjet ink, or a toner. As also previously mentioned, for other examples of the printable medium 100, the ink may be chosen from a pigment-based inkjet ink or a pigmented latex-based ink.

In describing and claiming the examples disclosed herein, the singular forms "a", "an", and "the" include plural referents unless the context clearly dictates otherwise.

It is to be understood that the ranges provided herein include the stated range and any value or sub-range within the stated range. For example, a range from about −80° C. to about 0° C. should be interpreted to include not only the explicitly recited limits of about −80° C. to about 0° C., but also to include individual values, such as −70° C., −45° C., −22° C., etc., and sub-ranges, such as from about −55° C. to about −15° C., from about −35° C. to about −2° C., etc. Furthermore, when "about" is utilized to describe a value, this is meant to encompass minor variations (up to +/−5%) from the stated value.

While several examples have been described in detail, it will be apparent to those skilled in the art that the disclosed examples may be modified. Therefore, the foregoing description is to be considered non-limiting.

What is claimed is:

1. A printable medium, comprising:

an opaque substrate that is substantially free of polyvinyl chloride (PVC), including:

a fabric core having $I(x)/I_0$ equal to or less than 0.005, wherein I(x) is an intensity of light remaining at a distance, x, where x is the distance that light travels through the substrate, and wherein $I_0$ is an initial intensity of light at x=0, wherein the fabric core is formed from synthetic fibers of: polyesters, polyamides, polyimides, polyacrylics, polypropylenes, polyethylenes, polyurethanes, polystyrenes, polyaramids, polytetrafluoroethylene, fiberglass, polytrimethylene, polycarbonates, polyester terephthalate, polybutylene terephthalate, or combinations thereof, wherein the synthetic fibers are color treated with carbon black pigment; and a discrete barrier layer disposed on the fabric core, the discrete barrier layer including a copolymer of ethylene and vinyl acetate having a polyethylene-to-vinyl acetate weight ratio ranging from about 20:1 to about 9:1;

the printable medium further comprising:

a tie layer coated on the discrete barrier layer, the tie layer consisting of:

from about 70 wt % to about 95% of a polymeric tie component having a glass transition temperature ranging from about −80° C. to about 0° C.;

from about 5 wt % to about 30 wt % of a crosslinking agent; and from about 3 wt % to about 6 wt % of a solvent; and an image receiving layer coated on the tie layer.

2. The printable medium as defined in claim 1 wherein the tie layer has a thickness ranging from about 0.1 microns to about 2 microns.

3. The printable medium as defined in claim 2 wherein the tie layer has a thickness ranging from about 0.2 microns to less than 0.5 microns.

4. The printable medium as defined in claim 1 wherein the polymeric tie component is selected from the group consisting of styrene butadiene resin latex, acrylic latex, and combinations thereof.

5. The printable medium as defined in claim 1 wherein the printable medium is to receive thereon any of a pigment-based inkjet ink, a pigmented latex-based inkjet ink, a UV curable inkjet ink, or a dye-based inkjet ink, and wherein the image receiving layer includes:

a pigment chosen from silica gel, modified calcium carbonate, and precipitated calcium carbonate;

a binder; and a colorant fixing agent.

6. The printable medium as defined in claim 1 wherein the printable medium is to receive thereon any of a pigment-based inkjet ink or a pigmented latex-based inkjet ink, and wherein the image receiving layer is a porous film including at least two pigments having different pigment structure morphologies, one of the pigment structure morphologies being formed by crystalline pigment particles having a discrete acicular morphology and an aspect ratio ranging from about 50 to about 300, and an other of the pigment structure morphologies being formed by a porous, amorphous aggregated pigment having a surface area ranging from about 50 $m^2/g$ to about 300 $m^2/g$ as measured by the BET method and a pore volume of about 1.4 mL/g to about 30 mL/g as measured by a mercury porosimeter.

7. The printable medium as defined in claim 6 wherein the image receiving layer further includes a binder and a colorant fixing agent.

8. The printable medium as defined in claim 1 wherein the fabric core comprises woven fiber structures, non-woven fiber structures, knitted fiber structures, tufted fiber structures, and wherein the fibers structures include the synthetic fibers.

9. The printable medium as defined in claim 1 wherein the fabric core is a non-woven fabric having a web structure bonded by entangled fibers or filaments.

10. The printable medium as defined in claim 1 wherein the substrate has a basis weight ranging from about 200 gsm to about 500 gsm.

11. A method of making the printable medium of claim 1, the method comprising:

forming the substrate by disposing the discrete barrier layer on the fabric core;

coating the tie layer on the discrete barrier layer; and coating the image receiving layer on the tie layer.

12. The method as defined in claim 11 wherein the coating of the tie layer and the coating of the image receiving layer are each accomplished using a wet coating process.

13. A printed article, comprising:

the printable medium of claim 1; and any of a pigment-based inkjet ink, a pigmented latex-based inkjet ink, a UV curable inkjet ink, or a dye-based inkjet ink deposited on the printable medium.

14. The printable medium as defined in claim 1 wherein the image receiving layer includes a colorant fixing agent selected from the group consisting of calcium chloride, manganese (II) chloride, and combinations thereof.

15. The printable medium as defined in claim 1 wherein the image receiving layer includes polydiallyldimethylammonium chloride.

16. The printable medium as defined in claim 1 wherein the discrete barrier layer further includes high density polyethylene, low density polyethylene, polypropylene, polylactic acid, polyethylene terephthalate, or a combination thereof.

17. The printable medium as defined in claim 1, wherein the polymeric tie component includes polyvinyl alcohol in combination with styrene butadiene resin latex or acrylic latex.

18. The printable medium as defined in claim 1 wherein:

the fabric core is woven polyethylene; and the opaque substrate further includes an other discrete barrier layer disposed on an opposed surface of the fabric core.

19. The printable medium as defined in claim 18 wherein each of the discrete barrier layer and the other discrete barrier layer includes a combination of a polyolefin resin and the copolymer of ethylene and vinyl acetate, the polyolefin resin being selected from the group consisting of high density polyethylene, low density polyethylene, and a combination thereof.

20. The printable medium as defined in claim 1 wherein the discrete barrier layer includes a blend of low density polyethylene and the copolymer of ethylene and vinyl acetate, and wherein a weight ratio of the low density polyethylene to the copolymer of ethylene and vinyl acetate ranges from about 1:99 to about 50:50.

21. The printable medium as defined in claim 1 wherein the fabric core has a color space coordinate L* that is less than 30.

22. The printable medium as defined in claim 1 wherein the fabric core has a color space coordinate L* that is greater than 30.

23. The printable medium as defined in claim 1 wherein the fabric core has a stiffness ranging from about 5 gf·cm to about 100 gf·cm.

24. The printable medium as defined in claim 1 wherein the image receiving layer consists of:

from about 65 wt % to about 85 wt % of a pigment selected from the group consisting of silica gel, modified calcium carbonate, and precipitated calcium carbonate;

from about 15 wt % to about 30 wt % of polyvinyl alcohol;

from about 3 wt % to about 10 wt % a colorant fixing agent selected from the group consisting of calcium chloride and manganese chloride; and an additive selected from the group consisting of a crosslinking agent, a surfactant, a defoamer, a pH adjuster, a cationic additive, and combinations thereof.

25. The printable medium as defined in claim 24 wherein the crosslinking agent in the image receiving layer is from about 1 wt % to about 3 wt % of boric acid.

* * * * *